US010036978B2

(12) United States Patent
Imamiya et al.

(10) Patent No.: US 10,036,978 B2
(45) Date of Patent: Jul. 31, 2018

(54) IMAGE FORMING APPARATUS AND DEVELOPER REPLACEMENT METHOD OF IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Koji Imamiya, Kawasaki Kanagawa (JP); Kei Onishi, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/341,178

(22) Filed: Nov. 2, 2016

(65) Prior Publication Data

US 2018/0120732 A1 May 3, 2018

(51) Int. Cl.
*G03G 15/08* (2006.01)

(52) U.S. Cl.
CPC ..... *G03G 15/0824* (2013.01)

(58) Field of Classification Search
CPC ..... G03G 15/0824
See application file for complete search history.

(56) References Cited

U.S. PATENT DOCUMENTS 5,142,332 A * 8/1992 Osawa ..... G03G 15/0849 399/44
7,085,506 B2 * 8/2006 Forbes, II ..... G03G 15/0844 399/257
2006/0263106 A1 11/2006 Yamaguchi et al.
2009/0060533 A1 * 3/2009 Yamaguchi ..... G03G 15/553 399/27
2011/0052220 A1 * 3/2011 Nose ..... G03G 15/0844 399/27
2011/0052221 A1 * 3/2011 Hirobe ..... G03G 15/0877 399/27
2011/0064430 A1 3/2011 Mitamura et al.
2011/0194875 A1 * 8/2011 Inoue ..... G03G 15/0877 399/255

(Continued)

OTHER PUBLICATIONS

Extended European Search Report for European Patent Application No. 17198232.5 dated Mar. 9, 2018.

*Primary Examiner* — G. M. Hyder
(74) *Attorney, Agent, or Firm* — Amin, Turocy & Watson LLP

(57) ABSTRACT

An image forming apparatus of an exemplary embodiment includes a temperature sensor, a developing unit, a supply unit, and a control unit. The temperature sensor detects a temperature. The developing unit supplies developer to an image carrier and performs development. The supply unit contains developer and supplies the contained developer to the developing unit. The control unit executes developer replacement processing including discharging the developer from the developing unit and supplying the developer contained in the supply unit to the developing unit based on a first ratio which a ratio of a developer supply time during which the supply unit performs supply of the developer for the developing unit and a drive time during which the developing unit is driven and a threshold value obtained based on a detected temperature of a temperature sensor.

17 Claims, 9 Drawing Sheets

(56) References Cited

U.S. PATENT DOCUMENTS

| | | | | |
|---|---|---|---|---|
| 2011/0236074 | A1* | 9/2011 | Maeda | G03G 15/0893 399/254 |
| 2012/0070165 | A1 | 3/2012 | Suzuki | |
| 2013/0322893 | A1* | 12/2013 | Suzuki | G03G 15/0822 399/12 |
| 2015/0168873 | A1* | 6/2015 | Hamakawa | G03G 15/0893 399/53 |
| 2015/0248097 | A1 | 9/2015 | Nose et al. | |

* cited by examiner

FIG. 5

| DETECTED TEMPERATURE T | REPLACEMENT RATE THRESHOLD VALUE (E) |
|---|---|
| T≦20℃ | 2. 4 |
| 20℃<T≦30℃ | 2. 6 |
| 30℃<T≦40℃ | 2. 8 |
| 40℃<T≦45℃ | 3. 0 |
| 45℃<T | 3. 3 |

IMAGE FORMING APPARATUS AND DEVELOPER REPLACEMENT METHOD OF IMAGE FORMING APPARATUS

FIELD

Embodiments described herein relate to a technology for replacing developer of an image forming apparatus.

BACKGROUND

In the related art, an image forming apparatus using developer of two-component mixture containing a carrier and a toner is known. The carrier is a substance which is stirred with toner particles in a container and which imparts electric charge to the toner particles and conveys the toner to a surface of a photoconductive substance.

In the image forming apparatus, when an image is formed on a sheet in a state where a printing rate is low, a toner inside a developing container may be degraded. In particular, toner for low temperature fixation which is recently provided in a market may be fixed on a sheet at a low temperature while the toner has low thermal resistance characteristics and is easily soluble and thus, an external additive on a surface of toner may be easily embedded into or separated from the toner surface. Especially, when stirring is continued in a state where the developer is not replaced, an external additive is embedded into or separated from the surface of toner as described above and developing capability to an image carrier (photoconductive drum) is lowered.

For that reason, a degraded toner needs to be replaced with a supplying toner regularly (refresh operation). In this context, an image forming apparatus that performs a determination whether a replacement of a toner is needed or not based on a time at which developing is performed or the number of sheets subjected to print processing, and a printing rate per a single sheet, and replaces the toner is known.

However, in the related art, a cumulative counter is reset after the toner replacement operation is performed, without determining whether the degraded toner is sufficiently output. Accordingly, whether effective developing may be performed is uncertain. Although the toner replacement operation is performed, when the degraded toner is not sufficiently output, effective developing may not be performed.

DESCRIPTION OF THE DRAWINGS

FIG. 5 illustrates a table of a correspondence relationship between a detected temperature and a replacement rate threshold value.

DETAILED DESCRIPTION

An image forming apparatus of an exemplary embodiment includes a temperature sensor, a developing unit, a supply unit, and a control unit. The temperature sensor detects a temperature. The developing unit supplies developer to an image carrier and performs development. The supply unit contains the developer and supplies the contained developer to the developing unit. The control unit executes developer replacement processing of discharging the developer from the developing unit and supplying the developer contained in the supply unit to the developing unit based on a first ratio which is a ratio of a developer supply time during which the supply unit performs supply of the developer for the developing unit and a drive time during which the developing unit is driven and a threshold value obtained based on a detected temperature of a temperature sensor.

A problem to be solved by the present disclosure is to provide an image forming apparatus capable of performing developer replacement with a high accuracy.

In the following, an image forming apparatus of the exemplary embodiment will be described with reference to drawings. In the exemplary embodiment, a two-component developer with toner, of which a glass transition temperature Tg is less than or equal to 50° C., is used in order to cope with low temperature fixation. Other types of developers can be alternatively employed. A glass transition temperature Tg of a normal toner in the related art is approximately 65° C., however, a toner for low temperature fixation of the present exemplary embodiment is regarded as a toner having a fixation temperature of at least less than or equal to 50° C. and more particularly, from approximately 40° C. to 41° C.

Figure 1:
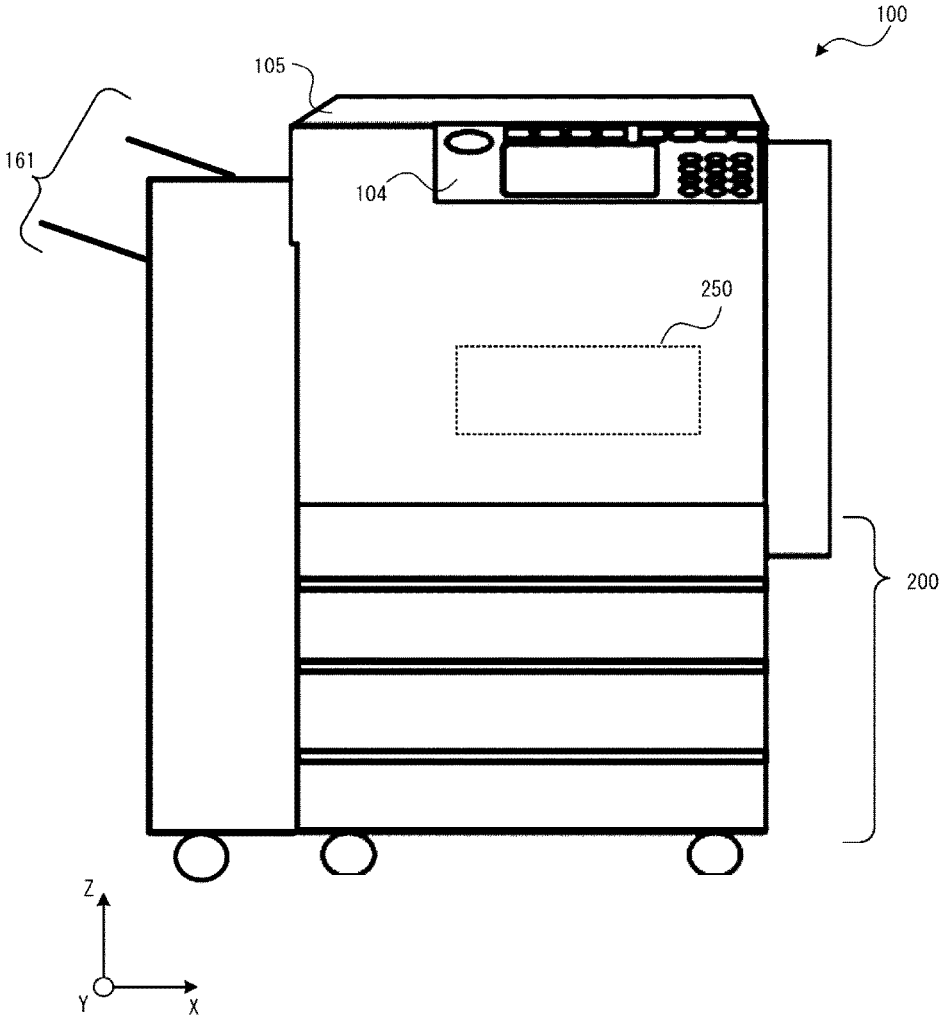
FIG. 1 illustrates a diagram of an example of an image forming apparatus of an exemplary embodiment.

FIG. 1 illustrates a diagram of an example of an image forming apparatus of an exemplary embodiment. A dotted line within the figure illustrates a unit positioned inside the apparatus.

An image forming apparatus 100 is, for example, a composite machine (multi function peripheral (MFP)) capable of forming a toner image on a sheet. The image forming apparatus 100 is equipped with, for example, a printer function, a copy function, a scanner function, and a facsimile function.

The image forming apparatus 100 includes an image read unit 105, a sheet accommodation unit 200, an image forming unit 250, a sheet discharge unit 161, and a control panel 104.

The image read unit 105 reads images from an original sheet placed on a predetermined position. For example, the image read unit 105 includes an image-capturing element such as a charge coupled device (CCD) or a contact image sensor (CIS). The image read unit 105 reads an image from the original sheet placed on a predetermined position by the image-capturing element and generates image data. The image read unit 105 outputs the generated image data to the image forming unit 250. The image read unit 105 may output, for example, the generated image data to a control unit 41 which will be described later. The image read unit 105 may transmit the generated image data to other information processing apparatuses through a network, for example.

The control panel 104 is provided with a display unit and an operation unit. The display unit is a display device such as a liquid crystal display, an organic electro luminescence (EL) display, or the like. The display unit displays various pieces of information about the image forming apparatus 100. The operation unit is provided with a plurality of buttons or the like. The operation unit receives user's operation to the plurality of buttons. The control panel 104 outputs an instruction signal according to the user's operation by the operation unit to the control unit 41 which will be described later. The control panel 104 may be a touch panel display in which a display unit and an operation unit are integrally formed.

The image forming unit 250 forms an image on a surface of a sheet based on the image data generated by the image read unit 105 (copy function). The image forming unit 250 may form an image on a surface of a sheet based on image data transmitted by other information processing apparatuses through the network (printer function). The image forming unit 250, for example, forms an image on a surface of a sheet with a toner. The formed image is referred to as a toner image, as needed.

In the present exemplary embodiment, the toner includes a decolorable toner and a non-decolorable toner. The non-decolorable toner is, for example, a toner of yellow (Y), magenta (M), cyan (C), and black (K). The decolorable toner is a colored toner similar to the non-decolorable toner. The decolorable toner decolorizes an image at a temperature higher than a temperature at which the non-decolorable toner is fixed on the sheet. Decolorization means that an image formed with a color (including chromatic color as well as achromatic color such as white and black) different from a color of a base of a paper is not visually seen.

The toner of the exemplary embodiment is regarded as a toner for low temperature fixation of Tg of approximately from 40° C. to 41° C. (less than or equal to 50° C.).

The sheet accommodation unit 200 is provided with a plurality of paper feeding cassettes. Each of paper feeding cassettes accommodates sheets of a predetermined size and type. Each of paper feeding cassettes is provided with a pickup roller which takes the accommodated sheets out one by one.

The sheet accommodated in the sheet accommodation unit 200 is conveyed to the image forming unit 250. The image forming unit 250 forms an image on the sheet according to an image of an original document read by the image read unit 105 or print data transmitted from other information processing apparatuses. The sheet on which an image is formed is discharged by the sheet discharge unit 161.

Figure 2:
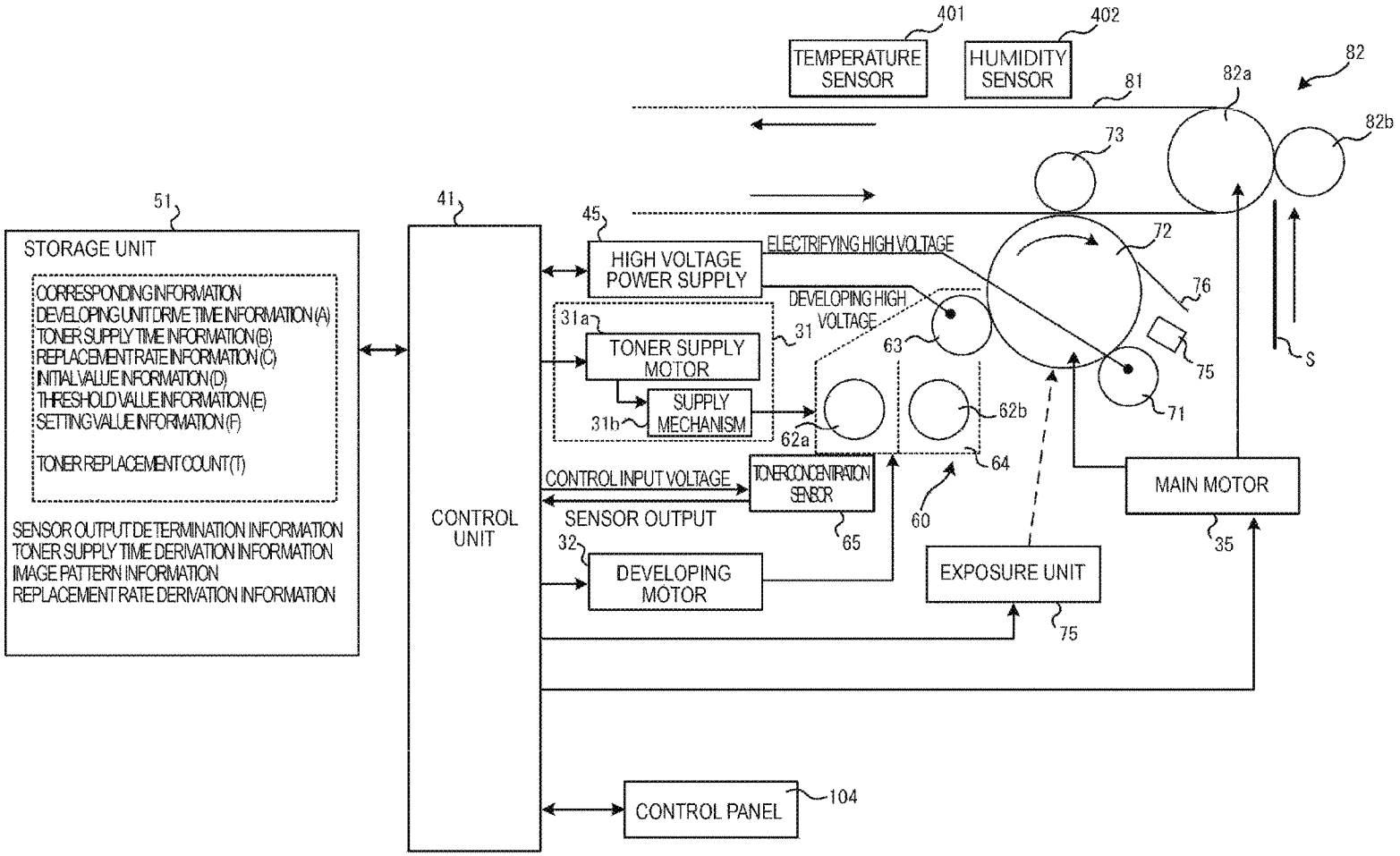
FIG. 2 illustrates a schematic diagram of an example of an internal configuration of the image forming apparatus.

FIG. 2 illustrates a schematic diagram of a portion of the image forming apparatus 100, especially a schematic diagram illustrating mainly the image forming unit 250. In FIG. 2, a configuration with toner of one color (for example, yellow (Y)) is illustrated, however, a magenta (M) toner, a cyan (C) toner, a black (K) toner, and a decolorable (D) toner are also similarly configured.

In the periphery of a developing unit 60, a photoconductive drum 72 (image carrier), a charging unit 71, an electricity elimination unit 75, a cleaning unit 76, and a transfer roller 73 are provided.

The developing unit 60 is provided with a developer containing unit 64, a developing roller 63, a first mixer 62*a*, a second mixer 62*b*, and a toner concentration sensor 65, and is driven by obtaining power from the developing motor 32. The developing unit 60 supplies developer existing inside the developer containing unit 64 to a photoconductive drum 72. The developing roller 63 is an example of a supply mechanism. The developing motor 32 is an example of a power-supplying and driving unit and controls driving of the developing roller 63, the first mixer 62*a*, and the second mixer 62*b*. The toner concentration sensor 65 is an example of a detection unit, receives a voltage for control from the control unit 41 as an input, and outputs a sensed result to the control unit 41.

The developer containing unit 64 is a container containing developer. The developer is a mixture of a carrier consisting of magnetic fine particles and each toner. When developer particles are stirred by the first mixer 62*a* and the second mixer 62*b*, the toner is charged by friction. Thus, the toner is adhered to the surface of the carrier by an electrostatic force.

The first mixer 62*a*, the second mixer 62*b*, and the developing roller 63 are disposed inside the developer containing unit 64. The first mixer 62*a* and the second mixer 62*b* stir the developer and convey the developer. The second mixer 62*b* is disposed below the developing roller 63 and supplies the developer contained in the developer containing unit 64 to the surface of the developing roller 63. The developing roller 63 is rotated in the counterclockwise direction illustrated in the figure by driving of the developing motor 32. The developing roller 63 is made of magnetic substance (magnet) and a positive electrode and a negative electrode are alternately aligned along a circumferential shape by a developing high voltage from a high voltage power supply 45. The developer supplied by the second mixer 62*b* is adhered to the surface of the developing roller 63 according to a magnetic field distribution generated by a configuration of magnetic substance (magnet) arrangement. The magnetic field distribution of the developing roller 63 is switchable. The developing unit 60 performs adhesion or release of adhesion of the developer by switching of the magnetic field distribution of the developing roller 63.

A photoconductive layer is provided on a surface of the photoconductive drum 72. The photoconductive drum 72 is rotated in a clockwise direction illustrated in the figure by driving of the main motor 35. The charging unit 71, the developing unit 60, the transfer roller 73, the cleaning unit 76, and the electricity elimination unit 75 are disposed in the periphery of the photoconductive drum 72. The exposure unit 75 is disposed below the developing device 60 and the charging unit 71.

The charging unit 71 uniformly charges the surface (photoconductive layer) of the photoconductive drum 72 by the electrifying high voltage output from the high voltage power supply 45. For example, the charging unit 71 charges the surface of the photoconductive drum 72 to be in the negative polarity. The charging unit 71 charges the photoconductive drum 72 such that only the toner among the developer adhered to the surface of the developing roller 63 is adhered to the surface of the photoconductive drum 72. In this case, an electrostatic latent image is formed on the surface of the photoconductive drum 72 by an exposure unit 75. Accordingly, the toner is adhered to the electrostatic latent image of the photoconductive drum 72 from the developing roller 63. Thus, the toner image is formed on the surface of the photoconductive drum 72.

The cleaning unit 76 removes untransferred toners or the like on the surface of the photoconductive drum 72 by performing scraping off or the like of the untransferred toners. The cleaning unit 76 is provided on a stage at the rear of the position (position of the transfer roller 73) at which the toner image on the surface of the photoconductive drum 72 is transferred to an intermediate transfer belt 81. In an example of FIG. 2, the photoconductive drum 72 rotates in a clockwise direction illustrated in the figure. Thus, the cleaning unit 76 removes the toner on the surface of the photoconductive drum 72 after the toner image is transferred to the intermediate transfer belt 81 from the photoconductive drum 72. The toners removed by the cleaning unit 76 are collected in a waste toner tank and discarded.

The electricity elimination unit 75 faces the photoconductive drum 72 passing through the cleaning unit 76. The electricity elimination unit 75 irradiates the surface of the photoconductive drum 72 with light. Thus, non-uniform charges of the photoconductive layer are made uniform. That is, the photoconductive layer is subjected to elimination of electricity.

The transfer roller 73 faces the photoconductive drum 72 by nipping the intermediate transfer belt 81 between the transfer roller 73 and the photoconductive drum 72 and abuts against the surface of the photoconductive drum 72 by nipping the intermediate transfer belt 81 between the transfer roller 73 and the photoconductive drum 72. The transfer roller 73 transfers (primary transfer) the toner image on the surface of the photoconductive drum 72 onto the intermediate transfer belt 81.

The exposure unit 75 irradiates the surface of the photoconductive drum 72 with laser light. The emission of the exposure unit 75 is controlled based on the image data by control of the control unit 41. The exposure unit 75 emits laser light based on the image data. Thus, static electricity patterns (electrostatic latent image) are formed at a position irradiated with laser light on the surface of the photoconductive drum 72. The exposure unit 75 may use light emitting diode (LED) light instead of laser light.

The toner concentration sensor 65 detects a toner concentration in the developer containing unit 64. The toner concentration represents a ratio (toner/carrier) of a toner to a carrier. The toner concentration sensor 65 outputs the detected value representing the toner concentration to the control unit 41.

The transfer unit 82 is provided with a support roller 82*a* and a secondary transfer roller 82*b* that nips the sheet from both sides in a thickness direction. The support roller 82*a* obtains power by driving of the main motor 35 and moves the intermediate transfer belt 81 in an arrow direction. The position at which the support roller 82*a* and the secondary transfer roller 82*b* face with each other is a secondary transfer position. The transfer unit 82 receives transfer bias by the control unit 41 and transfers the toner image being charged on the surface of the intermediate transfer belt 81 on the surface of the sheet S in the secondary transfer position. Pressure and heat are applied to the sheet S on which the toner image is transferred by the fixing unit as in the related art.

The supply unit 31 is provided with a toner supply motor 31*a* and a supply mechanism 31*b*. The supply unit 31 drives the toner supply motor 31*a* according to the control instruction output by the control unit 41. The toner supply motor 31*a* operates the supply mechanism 31*b*. The supply mechanism 31*b* is connected to a toner cartridge not illustrated. The supply mechanism 31*b* operates according to driving of the toner supply motor 31*a* and supplies the toner contained in the toner cartridge to the developer containing unit 64. The toner supply motor 31*a* is an example of the toner-supplying and driving unit.

The image forming apparatus 100 includes a temperature sensor 401 and a humidity sensor 402. The temperature sensor 401 is a thermistor detecting temperatures inside the image forming unit 250 or the periphery of the outside the image forming unit 250. The humidity sensor 402 detects a relative humidity inside the image forming apparatus 100 or outside the image forming apparatus 100. The temperature sensor 401 and the humidity sensor 402 are regarded as a single sensor, respectively, in the present example, however, a plurality of sensors 401 and sensors 402 may be installed for every photoconductive substance of each color or the like. The values of the temperature and the humidity detected by the temperature sensor 401 and the humidity sensor 402 are output to the control unit 41.

The control unit 41 is a software functional unit. A processor executes a program to cause the software functional unit to function. The processor is, for example, a central processing unit (CPU). The control unit 41 may also be a hardware functional unit. For example, the control unit 41 is implemented by a large scale integration (LSI), an application specific integrated circuit (ASIC), or the like.

The storage unit 51 is implemented by a storage device such as a read only memory (ROM), a random access memory (RAM), a hard disk drive (HDD), a flash memory, or the like.

The storage unit 51 stores the image data generated by the image read unit 105 or image data transmitted by other information processing apparatuses through a network. The storage unit 51 stores the program executed by a processor of the control unit 41. The storage unit 51 stores, for example, pieces of corresponding information corresponding to each piece of identification information of the developing unit 60. That is, the storage unit 51 stores the piece of corresponding information for each color. The piece of corresponding information includes developing unit drive time information (A), toner supply time information (B), replacement rate information (C), initial value information (D), threshold value information (E), setting value information (F), and toner replacement count (T). The storage unit 51 stores sensor output determination information, toner supply time derivation information, image pattern information, and replacement rate derivation information. These various pieces of information will be described later.

In the following, examination items and results regarding a relationship between the temperature and the relative humidity detected by the sensors 401 and 402 and image contrast potential will be described. The image contrast potential means a potential difference between a DC component of the developing bias and the potential after exposure. If the image contrast potential is high, the toner and the carrier of the developer are adhered together to the surface of the photoconductive substance and, carrier development (development processing in a state where a toner as well as a carrier is adhered to the surface of the photoconductive substance) occurs. As a result, a rough image is formed on the sheet.

In the present exemplary embodiment, an examination has been performed for the following 4 patterns. The following respective patterns are performed under a condition that external environment is 30° C./85% RH (relative humidity). The condition is called an HH environment. These numerical values are an example and different results are obtained depending on the type of the image forming apparatus, conditions of individuals, and installed positions of the sensors.

(First Pattern)

One side printing of a printing rate of 1% is performed continuously on 10,000 sheets. If the continuous printing is performed under the HH environment, a temperature inside a machine body of the image forming apparatus 1 is increased and a temperature (temperatures of a drum thermistor) of the photoconductive drum reaches 45° C. A relative humidity inside the machine body is decreased due to receiving of an influence of a temperature increase and becomes 55% RH. Under this situation, upper limit sticking (a limit value example: 700 V) of the image contrast potential occurs in magenta and black and the carrier development is generated in magenta and black. The upper limit sticking refers to, in the present example, a state where the image contrast potential is always maintained in the limit value. The toner, of which the developing capability is deteriorated, becomes difficult to reach a desired concentration (adhesion amount) even when the image contrast potential is raised. In adjusting a concentration or the like, a control unit in the related art controls a concentration of toner to become a desired concentration as much as possible and thus, the control unit controls the image contrast potential to become 700 V which is the limit value and as a result, the state is maintained. With this, the upper limit sticking occurs. If the upper limit sticking occurs, the image is formed in a state where the image contrast potential is high and the carrier development occurs.

(Second Pattern)

One side printing of a printing rate of 4% is performed on 10,000 sheets. If the continuous printing is performed under the HH environment, the temperature of the drum thermistor and the relative humidity become 41° C. and 62% RH, respectively. Under this situation, the upper limit sticking does not occur and also the carrier development does not occur.

(Third Pattern)

Following the second pattern, one side printing of a printing rate of 1% is performed on 10,000 sheets. If the continuous printing is performed under the HH environment, the temperature of the drum thermistor and the relative humidity become 45° C. and 77% RH, respectively. Under this situation, the upper limit sticking (700 V) occurs in magenta and black and the carrier development is generated in magenta and black.

(Fourth Pattern)

Double side printing of a printing rate of 3% is performed on 10,000 sheets. If the continuous printing is performed under the HH environment, the temperature of the drum thermistor and the relative humidity become 44° C. and 81% RH, respectively. Under this situation, the upper limit sticking does not occur and also the carrier development does not occur.

When the printing rate is 1%, the upper limit sticking of the image contrast potential occurs and the carrier development is generated as illustrated in the first and third patterns. When the printing rate is 1%, a replacement amount of toner in approximately 400 g of developer is small and even when printing of 10,000 sheets is performed, approximately half of the toner particles (approximately 20 g) have been continuously stirred in the developing device from the start of printing. With this, external additives are embedded into or separated from the toner surface and the developing capability to the photoconductive substance is lowered. Accordingly, even when the control unit raises image contrast potential to an upper limit (700 V in the present example), a toner does not reach a desired concentration and contrast of an image is stuck at the upper limit. As a result, the carrier development occurs.

In the exemplary embodiment, replacement processing is performed for the toner degraded due to embedding or separation of the external additive of toner described above. That is, when the replacement amount of toner inside the developer containing unit 64 is small, the control unit 41 performs processing for replacing the toner inside the developer containing unit 64 with a new toner. In general, a time period during which the toner (developer), of which consumption is small, resides in the developer containing unit 64 becomes longer. As a result, the toner (developer) of the developer containing unit 64 has a tendency that the number of times that toner particles are stirred by a first mixer 62*a* and a second mixer 62*b* becomes greater and a percentage of crushing is increased. Thus, the developer is degraded. When the degraded developer is used, the image quality is degraded or flecks may occur in the gradation of an image. Accordingly, the control unit 41 performs the toner replacement processing described above and prevents degradation of the image quality.

For example, the control unit 41 executes the toner replacement processing based on a ratio of a time during which the supply unit 31 supplies the toner to the developing unit 60 and a drive time during which the developing unit 60 is driven. The toner replacement processing represents processing for discharging the toner from the developer containing unit 64 of the developing unit 60 and supplying the toner to the developing unit 60 from the supply unit 31. The time, during which the supply unit 31 supplies toner to the developing unit 60, corresponds to a developer supply time or a toner supply time and the toner replacement processing corresponds to developer replacement processing.

Figure 3:
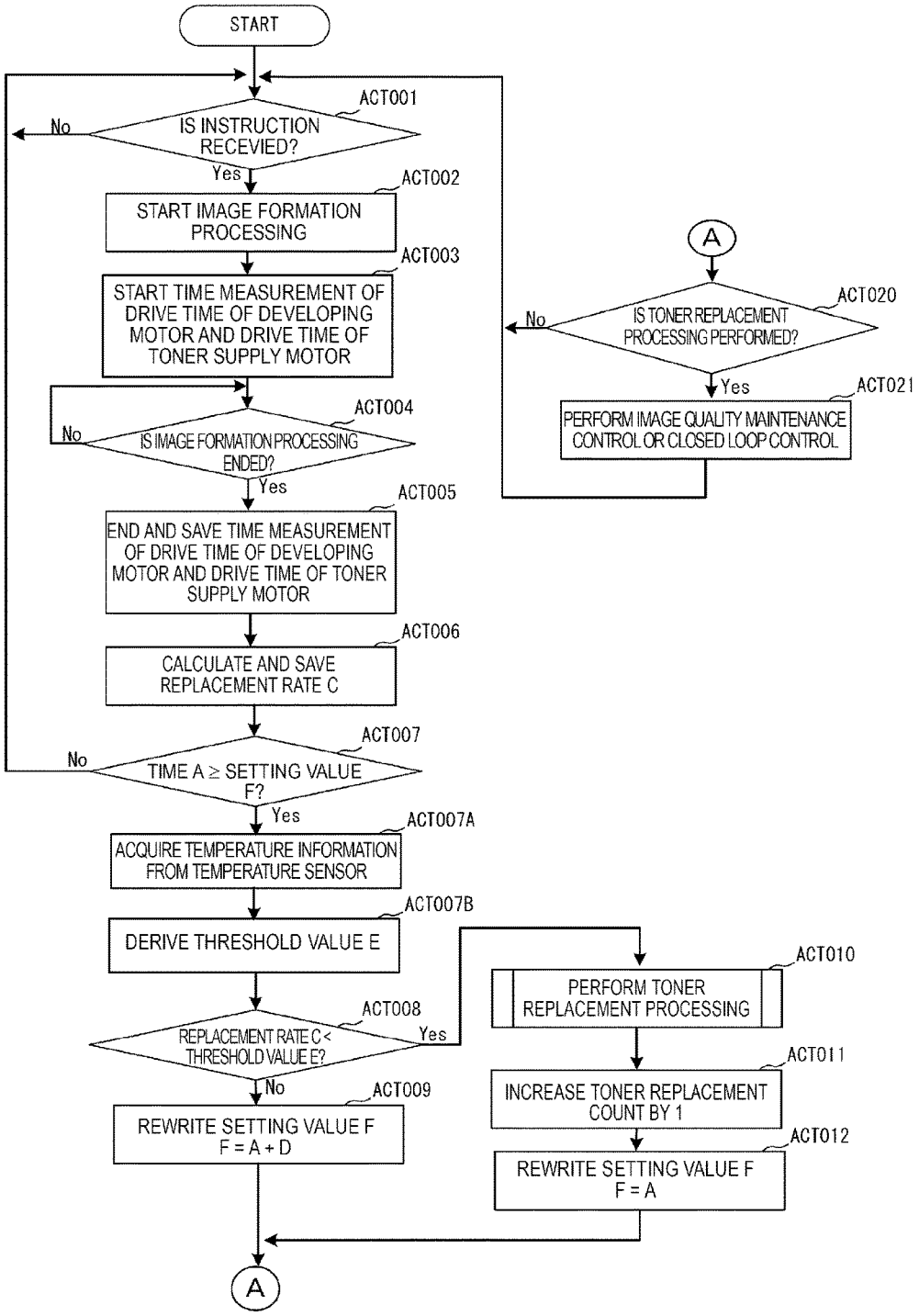
FIG. 3 illustrates a flowchart of an operation example of a control unit in an exemplary embodiment.

In the following, the toner replacement processing will be described based on a flowchart. FIG. 3 illustrates a flowchart of an example of flow of processing by the control unit 41 in the exemplary embodiment. The processing in the flowchart is repeatedly performed, for example, at a predetermined period.

First, the control unit 41 determines whether an instruction signal to form an image is received from the control panel 104 (ACT001) or not. When the instruction signal to form an image is not received (ACT001: No), the control unit 41 waits until the instruction signal to form an image is received.

On the other hand, when the instruction signal to form an image is received (ACT1001: Yes), the control unit 41 starts image formation processing (ACT002). The image formation processing refers that the control unit 41 performs the following processing.

The control unit 41 drives the developing motor 32 to operate the first mixer 62*a* and the second mixer 62*b*. The control unit 41 operates the first mixer 62*a* and the second mixer 62*b* to stir developer inside the developer containing unit 64. The control unit 41 controls the charging unit 71 such that the surface of the photoconductive drum 72 is charged while driving the developing motor 32 and rotating the photoconductive drum 72. The control unit 41 controls the exposure unit 75 and irradiates the charged photoconductive drum 72 with laser light of which emission is controlled based on the image data to form the electrostatic latent image. The control unit 41 drives the second mixer 62*b* and supplies the developer contained in the developer containing unit 64 to the surface of the developing roller 63. In this case, the control unit 41 controls the supply unit 31 such that a toner amount that amounts to the toner supplied to the surface of the developing roller 63 is supplied to the developer containing unit 64. The supply unit 31 is controlled by the control unit 41 to supply the toner contained in the toner cartridge to the developer containing unit 64.

The control unit 41 drives the developing motor 32 to adhere the toner on the surface of the developing roller 63 to the electrostatic latent image formed on the surface of the photoconductive drum 72. With this, the toner image is formed on the surface of the photoconductive drum 72. The control unit 41 drives the transfer roller 73 and the support roller 82*a* to move the intermediate transfer belt 81. In this case, the control unit 41 applies a voltage (transfer bias) to the transfer roller 73 described above and transfers the toner image on the surface of the photoconductive drum 72 onto the intermediate transfer belt 81. The control unit 41 controls a conveyance unit such that the sheet S accommodated in the sheet accommodation unit 200 is conveyed to the transfer unit 82. The control unit 41 drives a main motor 35 or the like to rotate a support roller 82*a* and a secondary transfer roller 82*b* and also applies a voltage to the secondary transfer roller 82*b* (transfer bias). With this, the toner image on the intermediate transfer belt 81 is transferred onto the sheet S in the secondary transfer position of the transfer unit 82. The control unit 41 controls the conveyance unit such that the sheet S onto which the toner image is transferred is conveyed to the fixing unit, the toner image is fixed, and is conveyed to a finisher or the like as in the related art. The control unit 41 repeats the processing described above until forming of an image is performed on the number of sheets S set by the user.

Description returns to the flowchart of FIG. 3. The control unit 41 starts to measure a drive time A of the developing motor 32 and a drive time B of the toner supply motor 31*a* immediately after the start of the image forming apparatus (ACT003). ACT003 is performed for each color.

In this case, the control unit 41 determines whether the drive time A of the developing motor 32 and the drive time B of the toner supply motor 31*a* already measured are stored in the storage unit 51 or not. For example, in the last processing, one or both of the drive time A of the developing motor 32 and the drive time B of the toner supply motor 31*a* may be stored in the storage unit 51. For that reason, the control unit 41 acquires developing unit drive time information A and toner supply time information B from the storage unit 51. The control unit 41 references the acquired developing unit drive time information A to determine whether the drive time A of the developing motor 32 is stored in the storage unit 51 or not. The control unit 41 references the acquired toner supply time information B to determine whether the drive time B of the toner supply motor 31*a* is stored in the storage unit 51 or not.

When the drive time A of the developing motor 32 is already stored in the storage unit 51, the control unit 41 cumulatively adds a time A to be measured from now to time information which is already stored. When the drive time B of the toner supply motor 31*a* is already stored in the storage unit 51, the control unit 41 cumulatively adds a time B to be measured from now to time information B which is already stored.

On the other hand, when the drive time A of the developing motor 32 is not yet stored in the storage unit 51, the control unit 41 newly measures the drive time A of the developing motor 32. When the drive time B of the toner supply motor 31*a* is not yet stored in the storage unit 51, the control unit 41 newly measures the drive time B of the toner supply motor 31*a*.

The measurement of the drive time A of the developing motor 32 and the drive time B of the toner supply motor 31*a* described above is performed on each developing unit 60. In the present exemplary embodiment, the developing unit 60 may be provided according to a type of toner. For that reason, the drive time A of the developing motor 32 and the drive time B of the toner supply motor 31*a* are measured for each type of toner. Processing from ACT003 and subsequent Actions is performed for each type of toner of the developing unit 60.

Next, the control unit 41 determines whether the image formation processing is ended or not (ACT004). For example, when forming of an image is not performed on the number of sheets S set by the user, the control unit 41 determines that the image formation processing is not ended. When forming of an image is performed on the number of sheets S set by the user, the control unit 41 determines that the image formation processing is ended.

When it is determined that the image formation processing is not ended (ACT004: No), the control unit 41 waits until the image formation processing is ended. On the other hand, when it is determined that the image formation processing is ended (ACT004: Yes), the control unit 41 performs the following processing.

The control unit 41 ends the measurement of the drive time A of the developing motor 32 and the drive time B of the toner supply motor 31*a* started in ACT003 (ACT005). The control unit 41 stores the measured drive time A of the developing motor 32 in the storage unit 51 as the developing unit drive time information A. The control unit 41 stores the measured drive time B of the toner supply motor 31*a* in the storage unit 51 as the toner supply time information B.

Figure 4:
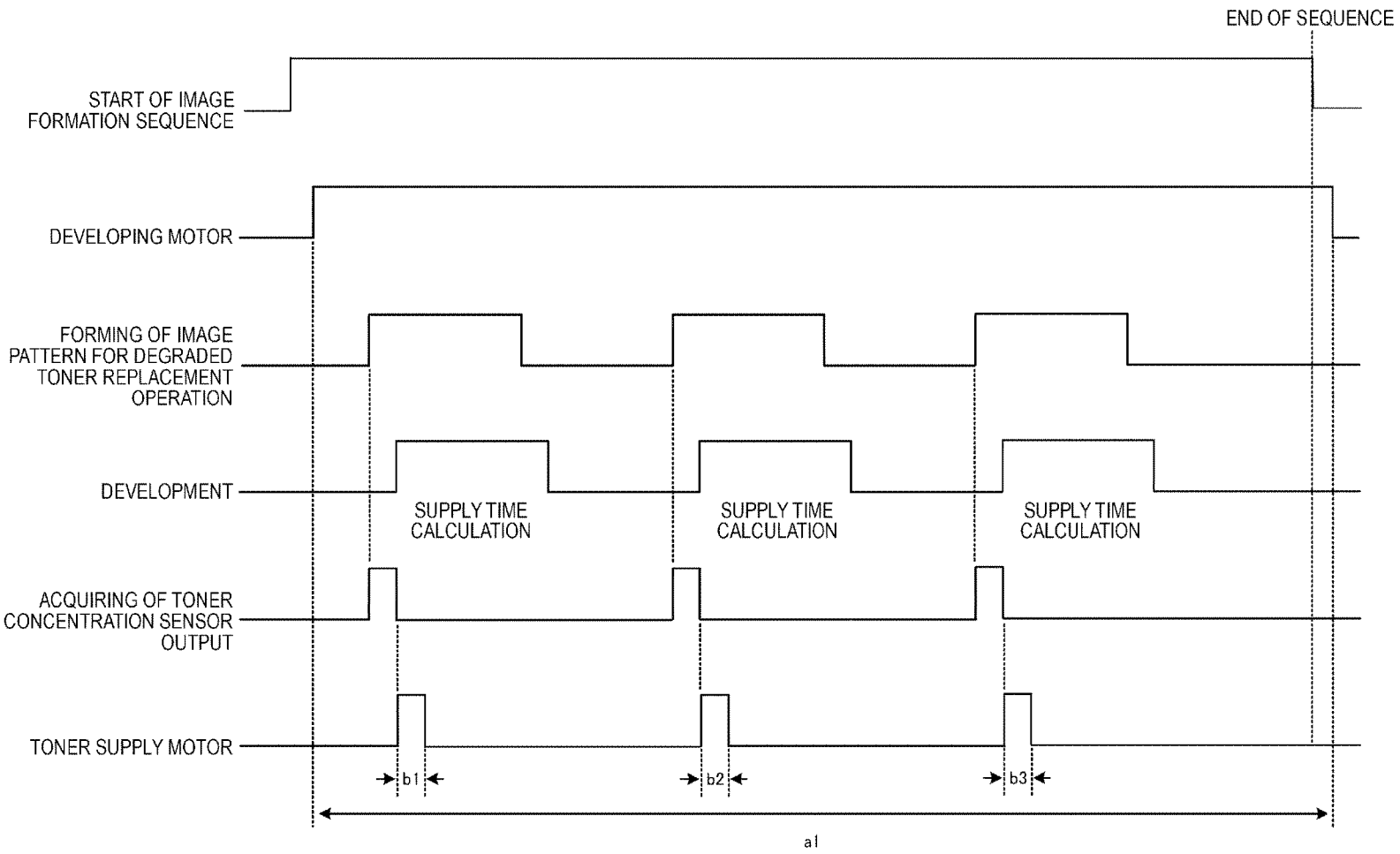
FIG. 4 illustrates a diagram for explaining a measurement method of a drive time of a developing motor and a drive time of a toner supply motor.

FIG. 4 illustrates a diagram for explaining a measurement method of the drive time A of the developing motor 32 and the drive time B of the toner supply motor 31*a*. For example, the drive time A of the developing motor 32 is derived by cumulatively adding a period of an on state of the developing motor 32. Specifically, a pulse length obtained by cumulatively adding a pulse width ranging from a rise to a fall of a rectangular-wave pulse, which indicates an on state of the developing motor 32, corresponds to the drive time A of the developing motor 32. In the illustrated example, a pulse width al corresponds to the drive time A of the developing motor 32. The drive time B of the toner supply motor 31*a* is derived by cumulatively adding a period of an on state of the toner supply motor 31*a*. In the illustrated example, a pulse length obtained by cumulatively adding pulse widths b1, b2, and b3 corresponds to the drive time B of the toner supply motor 31*a*.

The developing motor 32 is in a state of idling even in a period during which the development processing is not performed. The state of idling refers that the developing motor 32 is driven in a state where the photoconductive drum 72 is not charged, that is, a state where the charging unit 71 is not operated. In the following, description will be made by referring a time during which the motor is in a state of idling as an idling time. The control unit 41 may measure the drive time A of the developing motor 32 including the idling time so as to perform a calculation of a replacement rate C, which will be described later, with a high accuracy.

Description returns to the flowchart of FIG. 3. Next, the control unit 41 calculates a replacement rate C (ACT006). The replacement rate C is a parameter serving as an index when determining whether the toner is replaced or not in the processing which will be described later.

For example, the replacement rate C is defined as a value obtained by dividing the drive time B of the toner supply motor 31*a* by the drive time A of the developing motor 32. Accordingly, the control unit 41 references the developing unit drive time information A and the toner supply time information B stored in the storage unit 51 to calculate the replacement rate C. The control unit 41 stores the calculated replacement rate C in the storage unit 51 as calculated replacement rate information C. In first image forming processing, for example, a default value is stored in the toner supply time information B as the drive time B of the toner supply motor 31*a*. The developing unit drive time information A and toner supply time information B stored in the storage unit 51 are rewritten in the processing which will be described later.

Next, the control unit 41 determines whether the drive time A of the developing motor 32 is greater than or equal to a setting value F which is determined in advance or not (ACT007). The setting value F is stored in the storage unit 51 as setting value information F. The setting value F, for example, is set as a fixed value D which is a default in the first image forming processing. The fixed value D is stored in the storage unit 51 as initial value information D.

When the drive time A of the developing motor 32 is greater than or equal to the setting value F (ACT007: Yes), the control unit 41 determines that the developing unit 60 has been driven for a long period of time. On the other hand, when the drive time A of the developing motor 32 is less than the setting value F (ACT007: No), the control unit 41 determines that the developing unit 60 has not been driven for a long period of time, and returns the processing to ACT001.

When it is determined that the developing unit 60 has been driven for a long period of time, the control unit 41 acquires the temperature information of a current state detected by the temperature sensor 401 (ACT007A). The control unit 41 derives a threshold value E used for a comparison with the replacement rate C based on the acquired temperature information (ACT007B). In the present exemplary embodiment, the threshold value E is derived from the temperature detected by the temperature sensor 401 according to a correspondence relationship between the detected temperature and the replacement rate threshold value illustrated in FIG. 5. The correspondence relationship illustrated in FIG. 5 is stored in the storage unit 51 as replacement rate derivation information. The replacement rate derivation information may be defined as a function of calculating a threshold value from the detected temperature or embedded into a program executed by the control unit 41.

The control unit 41 determines whether the replacement rate C is less than the threshold value E obtained in ACT007B (ACT008). The control unit 41 may compare a threshold value (stored as the threshold value information E in the storage unit 51) defined in advance with the replacement rate C.

When the replacement rate C is greater than or equal to the threshold value E (ACT008: No), the control unit 41 changes the setting value F by the following processing. The control unit 41 rewrites the setting value F into a sum (D+A) obtained by adding the fixed value D and the drive time A of the developing motor 32 (ACT009). Thereafter, the processing proceeds to ACT020.

On the other hand, when the replacement rate C is less than the threshold value E (ACT008: Yes), the control unit 41 performs toner replacement processing (ACT010). Details of the toner replacement processing will be described later.

The control unit 41 increases toner replacement count T by 1 (Act011) and the setting value F is rewritten into the drive time A of the developing motor 32 and updates the toner replacement count T of the storage unit 51 and the setting value information F (ACT012).

The control unit 41 determines whether the toner replacement processing is performed on even any one color in ACT020 (ACT020). The determination is made based on whether the toner replacement count T is increased or based on a flag value, which is not illustrated, indicating whether the toner replacement processing is performed.

When the toner replacement processing is performed (ACT020: Yes), the control unit 41 performs image quality maintenance control or closed loop control, which is a control for adjusting an operation amount by feed-backing data such as a movement amount (ACT021), and returns the processing to ACT001. Operation of ACT021 may adopt processing as in the related art.

Figure 6:
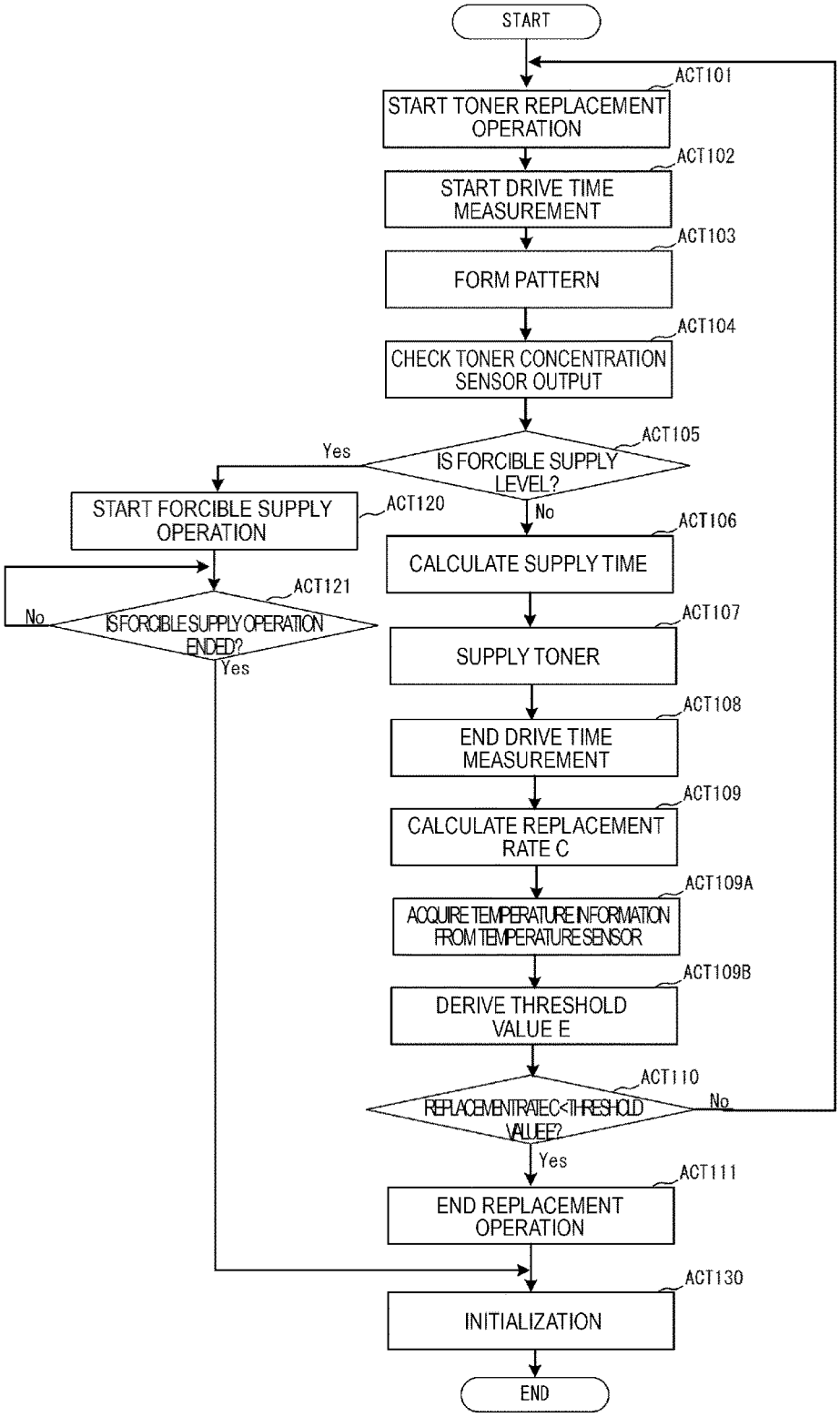
FIG. 6 illustrates a flowchart of an example of a flow of toner replacement processing of the control unit in an exemplary embodiment.

Next, the toner replacement processing in ACT010 will be described. FIG. 6 illustrates a flowchart of an example of flow of the toner replacement processing of the control unit 41 in the exemplary embodiment.

First, the control unit 41 starts an toner replacement operation (ACT101). In this case, the control unit 41 starts to measure the drive time A of the developing motor 32 and the drive time B of the toner supply motor 31*a* (ACT102).

The control unit 41 controls the exposure unit 75 to irradiate the charged photoconductive drum 72 with laser light of which emission is controlled based on predetermined image pattern data. The predetermined image pattern data is stored in the storage unit 51 as image pattern information in advance. Thus, a predetermined toner image (electrostatic latent image) is formed on the surface of the photoconductive drum 72 (ACT103).

The control unit 41 drives the transfer roller 73 and the support roller 82*a* to move the intermediate transfer belt 81 and transfers the toner image on the surface of the photoconductive drum 72 to the intermediate transfer belt 81. The control unit 41 does not convey the sheet S to the transfer unit 82 and drives the transfer roller 73 and the support roller 82*a* to cause the intermediate transfer belt 81 to be continuously moved. Thus, the toner adhered to the intermediate transfer belt 81 is removed by a cleaning unit not illustrated. The control unit 41 may also remove the toner image of the photoconductive drum 72 without transferring the toner image onto the intermediate transfer belt 81. For example, the control unit 41 rotates the photoconductive drum 72 continuously without applying a transfer bias to the photoconductive drum 72 so as to cause the cleaning unit 76 to remove the toner image of the photoconductive drum 72.

Next, the control unit 41 acquires an output value representing a toner concentration from the toner concentration sensor 65 (ACT104). Next, the control unit 41 determines whether the output value acquired from the toner concentration sensor 65 is a forcible supply level or not (ACT105).

Figure 7:
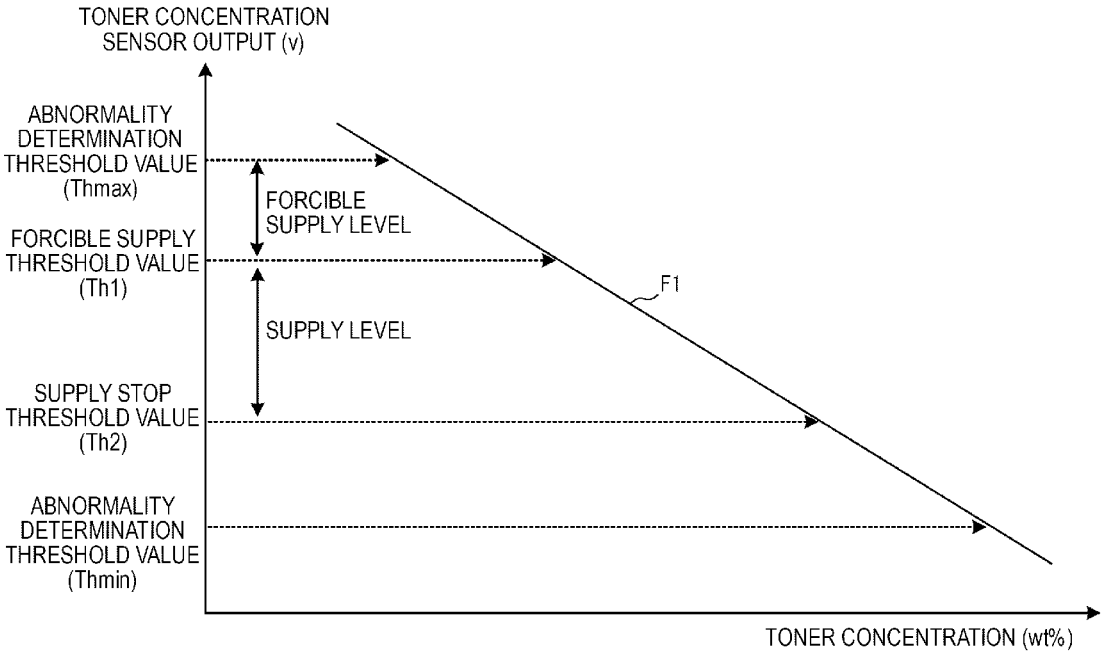
FIG. 7 illustrates a diagram of a relationship of a toner concentration to an output value of a toner concentration sensor.

FIG. 7 illustrates a diagram of a relationship of a toner concentration to an output value of the toner concentration sensor 65. The horizontal axis illustrated in FIG. 7 represents a toner concentration and the vertical axis represents an output value of the toner concentration sensor. For example, a unit of the horizontal axis is wt % and a unit of the vertical axis is v. As illustrated in FIG. 7, the relationship between the output value of the toner concentration sensor 65 and the toner concentration is represented by a linear function F1. The function F1 has a tendency that the output value (level) is decreased as the toner concentration is increased. The function F1 is stored in the storage unit 51 in advance as sensor output determination information. The sensor output determination information may also be table data corresponding to the function F1 instead of the function F1. The table data corresponding to the function F1 may also be embedded into a program referenced by a processor. In the function F1, four threshold values are provided. The four threshold values are an abnormality determination threshold value Thmax, an abnormality determination threshold value Thmin, a forcible supply threshold value Th1, and a supply stop threshold value Th2. Accordingly, output values of the toner concentration sensor 65 are classified by these four threshold values.

When the output value of the toner concentration sensor 65 is greater than or equal to the forcible supply threshold value Th1 and less than or equal to the abnormality determination threshold value Thmax, the control unit 41 determines that the output value is the forcible supply level. When the output value of the toner concentration sensor 65 is less than or equal to the forcible supply threshold value Th1 and greater than or equal to the supply stop threshold value Th2, the control unit 41 determines that the output value is not the forcible supply level. When the output value belongs to conditions other than the condition described above, conditions are handled as exceptional processing in the present exemplary embodiment.

When the output value of the toner concentration sensor 65 is the forcible supply level (ACT105: Yes), the control unit 41 starts the forcible supply operation (ACT120). The forcible supply operation is processing continuing supply of the toner until the output value of the toner concentration sensor 65 becomes less than or equal to the forcible supply threshold value Th1.

Figure 8:
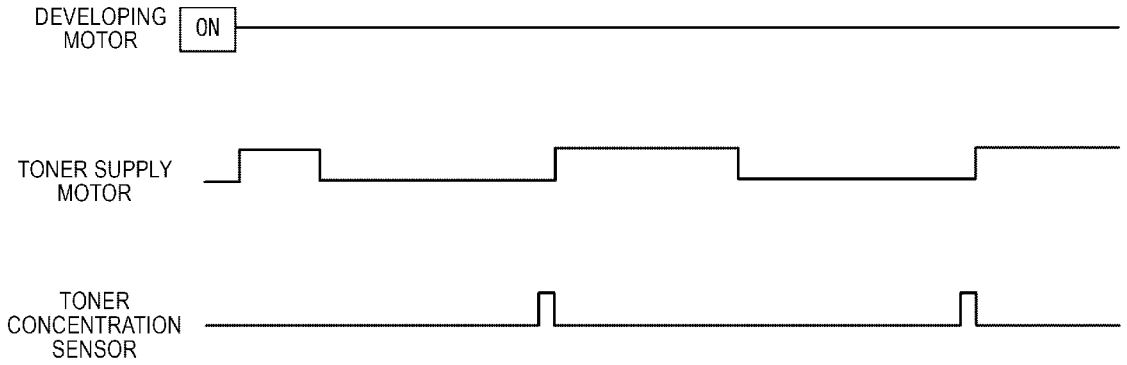
FIG. 8 illustrates a diagram for explaining a forcible supply operation.

In the following, description will be made on the forcible supply operation performed by the control unit 41 with reference to FIG. 8. As illustrated, the control unit 41 drives the developing motor 32 at all times and operates the first mixer 62*a* and the second mixer 62*b* during the forcible supply operation. Thus, the developing unit 60 stirs the carrier and newly supplied toner within the developer containing unit 64.

The control unit 41 intermittently drives the toner supply motor 31*a* and causes the supply unit 31 to supply the toner from the toner cartridge to the developer containing unit 64. In this case, the control unit 41 acquires the output value of the toner concentration from the toner concentration sensor 65 after the lapse of a predetermined time from a time point at which the toner supply motor 31*a* is driven once. The predetermined time, for example, is set as a time required for sufficiently stirring the supplied toner and the carrier. The control unit 41, for example, determines whether the output value of the toner concentration sensor 65 is less than or equal to the forcible supply threshold value Th1 according to the function F1 of FIG. 7 described above. That is, the control unit 41 determines whether the forcible supply operation is to be ended or not (ACT121). When the output value of the toner concentration sensor 65 is less than or equal to the forcible supply threshold value Th1, the control unit 41 determines that the forcible supply operation is to be ended. When the output value of the toner concentration sensor 65 is greater than the forcible supply threshold value Th1, the control unit 41 determines that the forcible supply operation is not to be ended.

When the forcible supply operation is not to be ended (ACT121: No), the control unit 41 drives the toner supply motor 31*a* again. With this, the control unit 41 causes the supply unit 31 to supply the toner from the toner cartridge into the developer containing unit 64. The control unit 41 repeats driving of the toner supply motor 31*a* and acquisition of the output value of the toner concentration sensor 65 until the output value of the toner concentration sensor 65 becomes less than or equal to the forcible supply threshold value Th1.

On the other hand, when the forcible supply operation is to be ended (ACT121: Yes), the control unit 41 performs initialization processing (ACT130). The initialization refers to performing the following processing. The control unit 41 clears a drive time, which is stored in the storage unit 51 as the developing unit drive time information A, of the developing motor 32 to zero. The control unit 41 clears a drive time, which is stored in the storage unit 51 as the toner supply time information B, of the toner supply motor 31*a* to zero. The control unit 41 rewrites a setting value stored as the setting value information F in the storage unit 51 into a fixed value (initial value information D) which is a default. The control unit 41 rewrites a value of the toner replacement count (T) into an initial value of zero. Thus, the processing of the present flowchart is ended.

On the other hand, when the output value of the toner concentration sensor 65 is not the forcible supply level (ACT105: No), the control unit 41 determines a toner supply time (ACT106).

Figure 9:
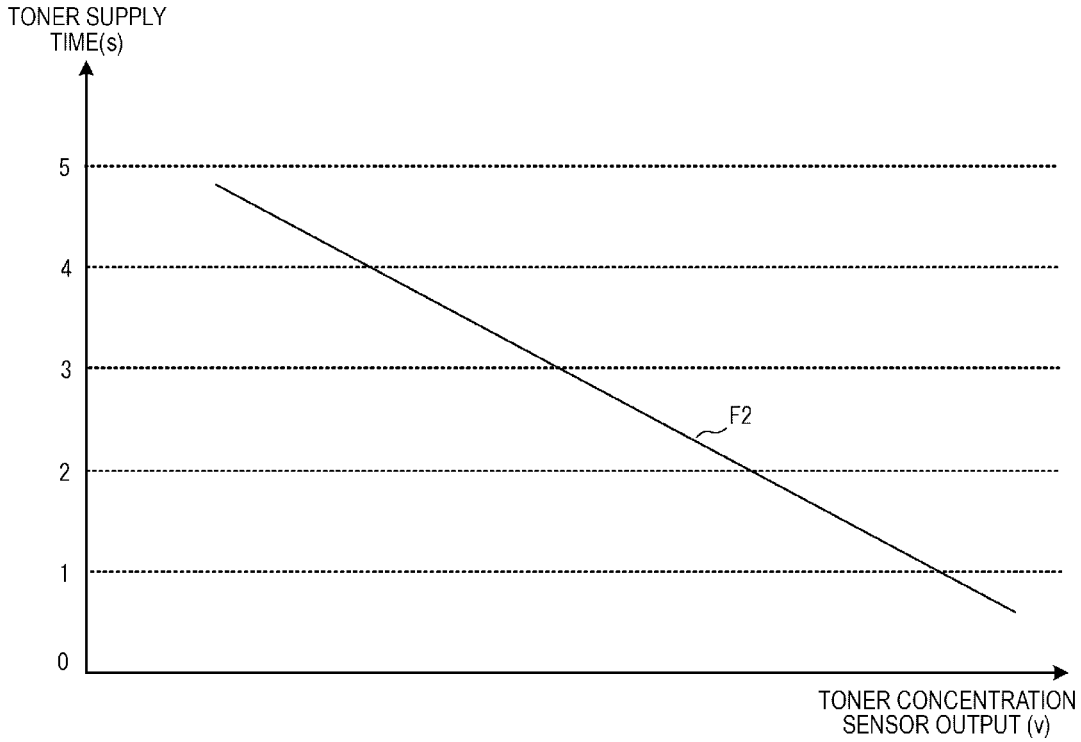
FIG. 9 illustrates a diagram of a relationship of an output value of the toner concentration sensor to a toner supply time.

FIG. 9 illustrates a diagram of a relationship of an output value of the toner concentration sensor 65 to a toner supply time. The horizontal axis illustrated in FIG. 9 represents an output value of a toner concentration sensor and the vertical axis represents a toner supply time. For example, a unit of the horizontal axis is v and a unit of the vertical axis is s. As illustrated in FIG. 9, a relationship between the toner supply time and the output value of the toner concentration sensor 65 is represented by a linear function F2. The function F2 has a tendency that the toner supply time is decreased as the output value of the toner concentration sensor 65 is increased. The function F2 is an example when a driving amount of the toner supply motor 31*a* is fixed.

The function F2 is stored in the storage unit 51 in advance as toner supply time derivation information. For example, the control unit 41 substitutes the output value acquired from the toner concentration sensor 65 into the function F2 to determine the toner supply time. The toner supply time derivation information may be table data corresponding to the function F2 instead of the function F2. The table data corresponding to the function F2 may also be embedded into a program referenced by a processor.

Next, the control unit 41 drives the toner supply motor 31*a* for the determined supply time and causes the supply unit 31 to supply the toner from the toner cartridge to the developer containing unit 64 (ACT107). Next, the control unit 41 ends the measurement of the drive time A of the developing motor 32 and the drive time B of the toner supply motor 31*a* (ACT108). The control unit 41 stores the measured drive time A of the developing motor 32 in the storage unit 51 as the developing unit drive time information A. The control unit 41 stores the measured drive time B of the toner supply motor 31*a* in the storage unit 51 as the toner supply time information B.

Next, similar to ACT006 described above, the control unit 41 calculates the replacement rate C (ACT109).

The control unit 41 acquires the temperature information of a current state detected by the temperature sensor 401 (ACT109A) and derives the threshold value E based on the temperature information and the correspondence relationship of FIG. 5 (ACT109B). The operations of ACT109A and ACT109B are similar to those of ACT007A and ACT007B, respectively.

Next, the control unit 41 determines whether the calculated replacement rate C is less than the threshold value E obtained in ACT109B or not (ACT110). When the replacement rate C is less than the threshold value E (ACT110: Yes), the control unit 41 ends the toner replacement operation (ACT111). Next, the control unit 41 performs the initialization processing of ACT130 described above and ends the processing of the present flowchart.

On the other hand, when the replacement rate C is not less than the threshold value E (ACT110: No), the control unit 41 determines that the replacement of toner is insufficient and returns the processing to ACT101. Thus, a toner concentration within the developer containing unit 64 is controlled such that the toner concentration falls within a predetermined range.

In the following, description will be made on an exceptional processing based on the output value of the toner concentration sensor 65 in ACT105. The exceptional processing is different from the processing of the present flowchart. For example, when the output value of the toner concentration sensor 65 is greater than or equal to the abnormality determination threshold value Thmax, the control unit 41 determines that an abnormality occurs in the image forming unit 250. When the output value of the toner concentration sensor 65 is less than or equal to the abnormality determination threshold value Thmin, the control unit 41 determines that an abnormality occurs in the image forming unit 250. When it is determined that an abnormality occurs in the image forming unit 250, the control unit 41 stops the processing of the image forming unit 250. When it is determined that an abnormality occurs in the image forming unit 250, the control unit 41 outputs information indicating that an abnormality has occurred to the control panel 104.

When the output value of the toner concentration sensor 65 is less than or equal to the supply stop threshold value Th2 and greater than or equal to the abnormality determination threshold value Thmin, the control unit 41 stops the supply of toner.

According to the image forming apparatus 100 of the exemplary embodiment described above, the drive time B of the toner supply motor 31*a* when the supply unit 31 performs the supply of toner is measured. The image forming apparatus 100 measures the drive time A of the developing motor 32 when the developing unit 60 is driven. The image forming apparatus 100 executes the toner replacement processing based on the replacement rate C which is a ratio of the measured drive time A of the developing motor 32 and the drive time B of the toner supply motor 31*a*.

For example, the toner replacement processing may be performed by referencing an index different from the present exemplary embodiment in executing the toner replacement processing. For example, when the toner replacement processing is executed using an index such as toner consumption, the following problems may occur. For example, when the first mixer 62*a* and the second mixer 62*b* are driven without supplying the toner to the photoconductive drum 72, a change in toner consumption does not occur. However, the toner particles are stirred and damaged, such as being crushed, within the developer containing unit 64, and the toner is degraded. In contrast, in the present exemplary embodiment, the replacement rate C is a ratio of the drive time A of the developing motor 32 and the drive time B of the toner supply motor 31*a*. That is, the replacement rate C is a rate based on a time spanning from a time when the toner is supplied into the developer containing unit 64 to a time when the toner particles are stirred in the developer containing unit 64. Accordingly, the image forming apparatus 100 of the exemplary embodiment may execute the toner replacement processing with a higher accuracy according to an actual degradation degree.

According to the image forming apparatus 100 of the exemplary embodiment, for example, the following processing is performed for the toner which is not an execution target of the toner replacement processing. The image forming apparatus 100 stores the measured drive time A of the developing motor 32 and the drive time B of the toner supply motor 31*a* in the storage unit 51 for next processing. The image forming apparatus 100 calculates the replacement rate C for toner, which is not replaced, by referencing the measured value to the previous measurement time. The image forming apparatus 100 calculates the replacement rate C for the toner, which is replaced, by referencing the current measured value. Thus, the image forming apparatus 100 calculates the replacement rate C for each kind of color of a toner (kind of developing unit 60). As a result, the image forming apparatus 100 may independently execute the toner replacement processing for each kind of color of a toner (kind of developing unit 60).

In the following, other exemplary embodiments will be described. When the instruction signal instructs to decolorize the sheet S, the control unit 41 described above sets a temperature of the fixing unit to be higher than the temperature when an image is formed. The control unit 41 controls the conveyance unit 50 to convey the sheet S to be decolorized to the fixing unit 70. In this case, the developing motor 32 is driven in association with conveyance of the sheet S. Accordingly, the developer within the developer containing unit 64 are stirred by the first mixer 62*a* and the second mixer 62*b*.

The control unit 41 may perform replacement processing of decolorable toner together with decolorizing of the sheet S. For example, the control unit 41 controls the conveyance unit 50 to convey the sheet S to the transfer unit 82 in the toner replacement processing. Thus, a toner image formed by the developing unit 60 containing the decolorable toner is transferred onto the sheet S to be decolorized. The control unit 41 conveys the sheet S on which the toner image formed by the decolorable toner is transferred to the fixing unit and performs decolorization processing and toner replacement processing simultaneously. As a result, the image forming apparatus 100 may implement efficient processing.

According to the image forming apparatus 100 of at least one of the exemplary embodiments described above, the drive time B of the toner supply motor 31*a* when the supply unit 31 performs the supply of toner is measured. The image forming apparatus 100 measures the drive time A of the developing motor 32 when the developing unit 60 is driven. The image forming apparatus 100 executes the toner replacement processing based on the replacement rate C which is a ratio of the measured drive time A of the developing motor 32 and the drive time B of the toner supply motor 31*a* and a threshold value obtained based on the detected temperature of the temperature sensor 401.

The threshold value (E) of the replacement rate is varied according to the temperature as in the present exemplary embodiment and as a result, image quality may be maintained. When the present exemplary embodiment is applied, in the condition of the first pattern, the drum thermistor temperature becomes 45° C. and the relative humidity becomes 58% RH, and a image in which the upper limit sticking (limit value example: 700 V) of the image contrast potential is not also generated in each color and an image without problem, whose image concentration is within a standard range, may also be obtained.

As having been described above, the image forming apparatus 100 may perform a replacement of developer (toner) with a high accuracy.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

a temperature sensor which detects a temperature inside the image forming apparatus;

a developing unit which supplies developer which contains a carrier and a toner to an image carrier and performs development;

a supply unit supplies the toner to the developing unit; and a control unit which calculates a first ratio of a toner supply time during which the supply unit performs supply of a fresh toner for the developing unit and a drive time during which a developing motor containing the developing unit is driven, and executes a toner replacement processing for discharging a deteriorated toner from the developing unit and supplying the fresh toner from the supply unit to the developing unit when the first ratio is less than a determined value which has a correspondence relationship according to the detected temperature of the temperature sensor, wherein a toner image formed by discharging the deteriorated toner from the developing unit in toner replacement processing is removed without transferring on a sheet.

2. The apparatus according to claim 1, wherein the control unit performs the toner replacement processing for each color of the developer.

3. The apparatus according to claim 2, wherein the control unit performs the toner replacement processing for yellow toner, magenta toner, cyan toner, and black toner of the developer.

4. The apparatus according to claim 1, wherein the control unit cumulatively adds a first time during which supply of the developer is performed for the developing unit when image formation processing is performed and a second time during which the developing unit is driven when the image formation processing is performed respectively to calculate the toner supply time and the drive time and initializes the toner supply time and the drive time after the toner replacement processing is performed.

5. The apparatus according to claim 4, wherein the control unit adds the first time during which supply of the developer is performed for the developing unit and the second time during which the developing unit is driven when the toner replacement processing is performed to the toner supply time and the drive time to calculate the first ratio.

6. The apparatus according to claim 1, further comprising:

a storage unit which stores the correspondence relationship between a value of the detected temperature and the determined value, wherein the control unit obtains the determined value from the correspondence relationship according to the detected temperature of the temperature sensor.

7. The apparatus according to claim 1, further comprising:

a concentration sensor which detects a concentration of the toner contained in the developer, wherein the control unit determines whether a forcible supply operation, which drives the developing unit at all times until reaching a specified concentration and stirs a carrier and a newly supplied toner, is performed or not based on the detected value of the concentration sensor.

8. The apparatus according to claim 7, wherein the control unit initializes the toner supply time and the drive time after performing the forcible supply operation.

9. A developer replacement method of an image forming apparatus including a developing unit which supplies developer which contains a carrier and a toner to an image carrier and performs development, a supply unit supplies the toner to the developing unit, and a temperature sensor which detects a temperature inside the image forming apparatus, the method comprising:

calculating a first ratio of a toner supply time during which the supply unit performs supply of a fresh toner for the developing unit and a drive time during which a developing motor containing the developing unit is driven; and performing a toner replacement processing for discharging a deteriorated toner from the developing unit and supplying the fresh toner from the supply unit to the developing unit when the first ratio is less than a determined value which has a correspondence relationship according to the detected temperature of the temperature sensor.

10. The method according to claim 9, further comprising, by the image forming apparatus, cumulatively adding a time during which supply of the developer is performed for the developing unit when image formation processing is performed and a time during which the developing unit is driven when the image formation processing is performed respectively to calculate the toner supply time and the drive time and initializing the toner supply time and the drive time after the toner replacement processing is performed.

11. The method according to claim 10, further comprising, by the image forming apparatus, adding the time during which supply of the developer is performed for the developing unit and the time during which the developing unit is driven when the toner replacement processing is performed to the toner supply time and the drive time to calculate the first ratio.

12. The method according to claim 9, further comprising performing the toner replacement processing for each color of the developer.

13. The method according to claim 9, further comprising:

storing the correspondence relationship between a value of the detected temperature and the determined value, and obtaining the determined value from the correspondence relationship according to the detected temperature.

14. The method according to claim 9, further comprising:

detecting a concentration of the toner contained in the developer, and determining whether a forcible supply operation, which drives the developing unit at all times until reaching a specified concentration and stirs a carrier and a newly supplied toner, is performed or not based on the detected value.

15. The method according to claim 14, further comprising initializing the toner supply time and the drive time after performing the forcible supply operation.

16. The method according to claim 9, further comprising performing the toner replacement processing for yellow toner, magenta toner, cyan toner, and black toner of the developer.

17. The method according to claim 9, further comprising performing the toner replacement processing for black toner of the developer.

* * * * *